US005706799A

United States Patent [19]

Imai et al.

[11] Patent Number: 5,706,799

[45] Date of Patent: Jan. 13, 1998

[54] OXYGEN RESPIRATOR HAVING $CO_2$ ABSORPTION MEANS

[75] Inventors: Masayuki Imai, Tokyo; Akira Kato, Hachiohji, both of Japan

[73] Assignee: Kikuchi Seisakusho Co., Ltd., Tokyo, Japan

[21] Appl. No.: 517,626

[22] Filed: Aug. 22, 1995

[30] Foreign Application Priority Data

Apr. 20, 1995 [JP] Japan ..... 7-095604

[51] Int. Cl.[6] ..... A62B 7/04; A62B 7/10; A62B 19/00

[52] U.S. Cl. ..... 128/205.12; 128/205.11; 128/205.22; 128/205.25; 128/205.28

[58] Field of Search ..... 128/205.11, 205.12, 128/205.22, 205.24, 205.25, 205.28, 202.26, 205.17

[56] References Cited

U.S. PATENT DOCUMENTS

| | | | |
|---|---|---|---|
| 3,604,416 | 9/1971 | Petrahai et al. | 128/205.17 X |
| 3,980,081 | 9/1976 | Cotabish et al. | 128/202.26 |
| 4,019,509 | 4/1977 | Li et al. | 128/202.26 |
| 4,155,361 | 5/1979 | Mascher | 128/202.26 |
| 4,157,091 | 6/1979 | Pampuch | 128/202.26 |
| 4,164,218 | 8/1979 | Martin | 128/202.26 X |
| 4,754,751 | 7/1988 | Mausteller et al. | 128/201.25 |
| 4,817,597 | 4/1989 | Tanaka | 128/205.17 |
| 4,840,170 | 6/1989 | Dahrendorf et al. | 128/202.26 |
| 4,917,081 | 4/1990 | Bartos | 128/205.12 |

*Primary Examiner*—Vincent Millin
*Assistant Examiner*—Eric P. Raciti
*Attorney, Agent, or Firm*—Browdy and Neimark

[57] ABSTRACT

An oxygen respirator with safety and simple handling, comprising a body, a small portable-type oxygen cylinder or oxygen generator mounted on the body, a mask, a first hose transferring oxygen from the body to the mask, a tank member mounted on the body for receiving exhalation, a second hose transferring exhalation from the mask to the body, and a carbon dioxide absorbing material charged in the body for removing carbon dioxide from exhalation sent back from the mask to the body. During emergency and evacuation for example in fire, thus, oxygen is transferred to the mask by removing a trigger or the like. The respirator also enables the reuse of exhalation for respiration. Despite of the small size, therefore, the respirator can protect a user from risks such as suffocation for a relatively long period of time.

11 Claims, 8 Drawing Sheets

OXYGEN RESPIRATOR HAVING $CO_2$ ABSORPTION MEANS

BACKGROUND OF THE INVENTION

1. Field of the Invention

The present invention relates to an oxygen respirator with safety and simple handling, which is capable of protecting persons and helping their evacuation against risks such as suffocation for a long duration during an emergency such as fire.

2. Prior Art

When a fire occurs to suffocate a person by smoke or when a person is put in an area or at a state with an extremely lower oxygen content, for example, inside a well or a petroleum tank, he or she should be at a state with a severely high risk. In such a case, it is required that he or she should escape from that place as far as possible while he or she protects the life by maintaining oxygen respiration. As a device to possibly maintain such countermeasure, it is illustrated of a type of respirators with an oxygen cylinder which the person should carry on the shoulder while wearing a mask over the mouth, the mask being connected through a hose to the cylinder. These have been used by members such as firemen and rescue crews if necessary for performing tasks.

An oxygen respirator in the form of a portable-type oxygen generator has been proposed without such oxygen cylinders. Such types of oxygen generators are classified into wet-type devices in which water is charged into a container to that is then added an oxygen generating agent (chemical agent) for reacting water with the agent to generate oxygen, the oxygen then being led to a mask through a pipe, and dry-type devices in which an oxygen generating agent is heated with a gunpowder and the like to generate oxygen which is then led through a pipe to a mask.

However, such conventional oxygen generators, for example the type of generators adopting an oxygen cylinder, are in preparation of a relatively large scale and with a heavy weight which can be used by specialists responsible for rescue actions as in fire fighting, so general people cannot use such generators by simple procedures. Also, the conventional oxygen generators for use in fire fighting have been used with safety without disadvantages, only if the oxygen content or the remaining life time is controlled by persons with specific knowledge. On the other hand, general people can manage such control with much difficulty. Since the gas filter masks also involve a risk of suffocation inside an area without oxygen, the masks are disadvantageously not effective in some area.

As shown in FIG. 1, the wet-type respirators among the oxygen respirators of the conventional oxygen generators are operated as follows; charging water into a container A and charging then chemical agent J into a filter D, followed by closing an upper lid B through a packing C and a locking handle H, generating oxygen through the reaction of the chemical agent J with water K, which is then transferred through feed hose F to a mask G. Therefore, such wet-type generators are disadvantageous in that it is required for a person to carry out laborious works to break the bag containing the chemical agent J to put the agent into the water K for the reaction of the chemical agent J with the water K. As to such wet-type generators, some positioning of an oxygen generator (which means that the whether oxygen generator is kept horizontal or inclined) involves difficulty in the separation of the water K and an oxygen generating agent or a solution of the chemical agent J from generated oxygen, also involving difficulty in the recovery of oxygen, disadvantageously.

As to the dry-type respirators among the oxygen respirators of the conventional oxygen generators, furthermore, problems occur in view of safety in heating an oxygen generating agent to generate oxygen and in view of the recovery of oxygen in that the yield of generated oxygen is low comparatively to the scale of the respirators.

In order to overcome the aforementioned problems, the present invention has been carried out. A first object of the present invention is to provide an oxygen respirator with safety and simple handling and being capable of protecting a personnel from risks such as suffocation for a relatively long period of time.

A second object of the present invention is to provide an oxygen respirator of a small scale and with higher safety, which enables respiration while generating a sufficient amount of oxygen with a simple procedure.

SUMMARY OF THE INVENTION

In order to achieve the aforementioned objects, the oxygen respirator in accordance with the present invention is principally composed of a body equipped with a cylinder mounting part, an oxygen cylinder mounted on the cylinder mounting part, a mask, a first hose transferring oxygen from the body to the mask, a tank member mounted on the body for receiving exhalation, a second hose transferring exhalation from the mask to the body, and a carbon dioxide absorbing material charged in the body for removing carbon dioxide from exhalation sent back from the mask to the body.

In accordance with the present invention, furthermore, instead of mounting an oxygen cylinder, an oxygen generator is mounted on the body, principally comprising a first hose transferring oxygen generated with the oxygen generator to a mask, a tank member mounted on the body for receiving exhalation, a second hose transferring exhalation from the mask to the body, and a carbon dioxide absorbing material charged in the body for removing carbon dioxide from exhalation sent back from the mask to the body.

By the aforementioned structure in accordance with the present invention, oxygen is fed from an oxygen cylinder or an oxygen generator, and the oxygen is then transferred through the first hose from the body to the mask. When a user breathes, oxygen is incorporated into the body of the user while exhalation containing carbon dioxide is exhaled. Transferring the exhalation through the second hose from the mask to the body, the flow of the exhalation is adjusted by the tank member and is then transferred to the carbon dioxide absorbing material. The carbon dioxide absorbing material removes carbon dioxide from the exhalation to increase the oxygen concentration to enable the recycling of the exhalation.

The present invention principally provides an oxygen respirator wherein an oxygen generator is provided while omitting a carbon dioxide absorbing material, to directly transfer oxygen generated from the oxygen generator for respiration. The oxygen generator to be used in the present invention comprises an outer case, an inner case placed inside the outer case having on its bottom a liquid tank such as a water bag and composing a container integrally with the outer case, and a needle or rod member passing through the central parts of the individual upper lids of the outer case and the inner case, the needle connecting an outer trigger to a support composed of a plane material for placing a chemical agent as an oxygen generating agent and having a tip facing downward, and wherein a space formed between the outer case and the inner case communicates through the permeation membrane of the inner case with the inner space of the inner case. In this case, preferably, permeation membranes are mounted at least on the upper parts and lower parts of the inner case and the outer case. Also, preferably, the liquid tank and the tank containing a chemical agent may be prepared in the form of a cartridge type. Furthermore, preferably, a safety device may be mounted on the trigger so as to normally prevent the operation of the trigger except in emergency.

When an emergency disaster such as fire occurs, the oxygen respirator of the present invention should be worn. By releasing the lever or releasing the safety unit to push the trigger inside, the tip of the needle breaks the liquid tank, whereby the liquid flows out for reaction with the chemical agent placed on the support, to generate oxygen. The generated oxygen passes through the permeation membranes to infiltrate into the space between the inner case and outer case, and is then charged into the surge tank to be transferred through the feed hose into the mask.

As has been described above, in accordance with the present invention, an oxygen respirator is composed of a body, a small portable-type oxygen cylinder or oxygen generator mounted on the body, a mask, a first hose transferring oxygen from the body to the mask, a tank member mounted on the body for receiving exhalation, a second hose transferring exhalation from the mask to the body, and a carbon dioxide absorbing material charged in the body for removing carbon dioxide from exhalation sent back from the mask to the body. Thus, the respirator is safe with simple handling and can protect a user from suffocation during emergencies such as fire for a long period of time.

The oxygen generator also enables ready and safe recovery of oxygen generated from the reaction of an oxygen generating material with water, irrespective of the direction and positioning of the generator. Furthermore, the recovery is sufficient (the generator can be used for 15 to 20 minutes). The generator can be designed at a small scale and of a light weight. By disposing the permeation membranes between the upper and lower parts of the outer case and the inner case and in the space inside the inner case, the dimension of the generator in the transverse direction can be decreased along with efficient recovery of generated oxygen. By preparing the liquid tank and the tank containing a chemical agent in the form of a cartridge type, furthermore, the exchange of the liquid tank and the tank containing the chemical agent can be done in a simple manner. Furthermore, by mounting a trigger and a safety device on the oxygen respirator of itself, any unnecessary motion of the respirator can be prevented with higher safety.

Further characteristics and advantages of the present invention will be apparent with reference to drawings.

DESCRIPTION OF THE PREFERRED EMBODIMENTS

Figure 1:
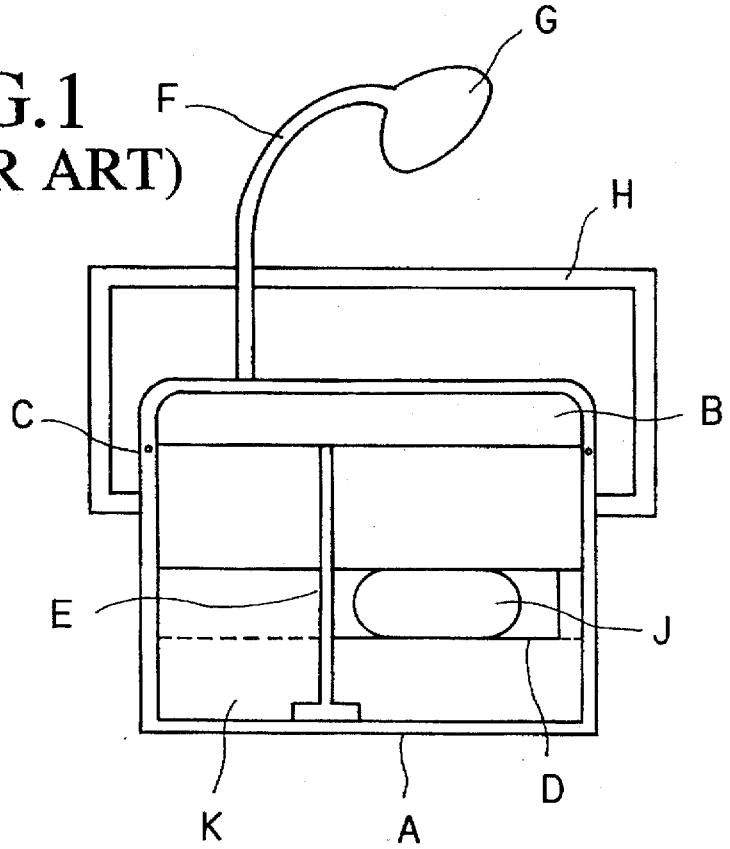
FIG.1 (PRIOR ART)
FIG. 1 is a front cross-sectional view of an oxygen respirator equipped with a conventional wet-type oxygen generator.
Figure 3:
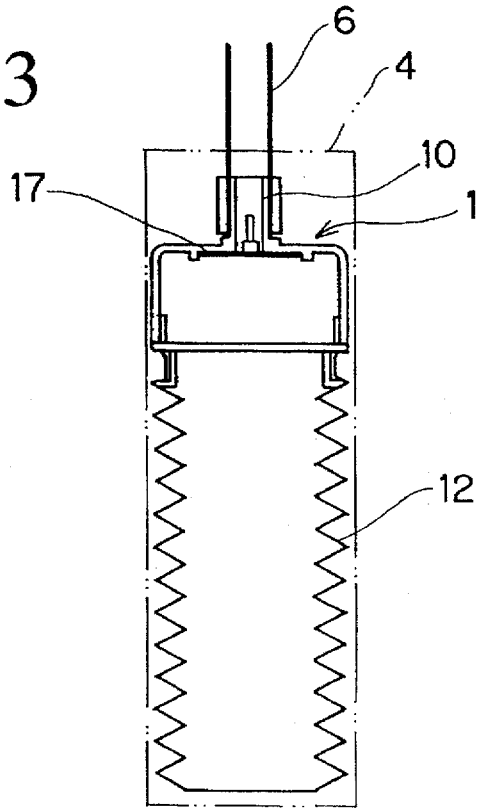
FIG. 3 is a cross-sectional view taken along the line A—A in FIG. 2, depicting the side view of the oxygen respirator of the first embodiment.
Figure 2:
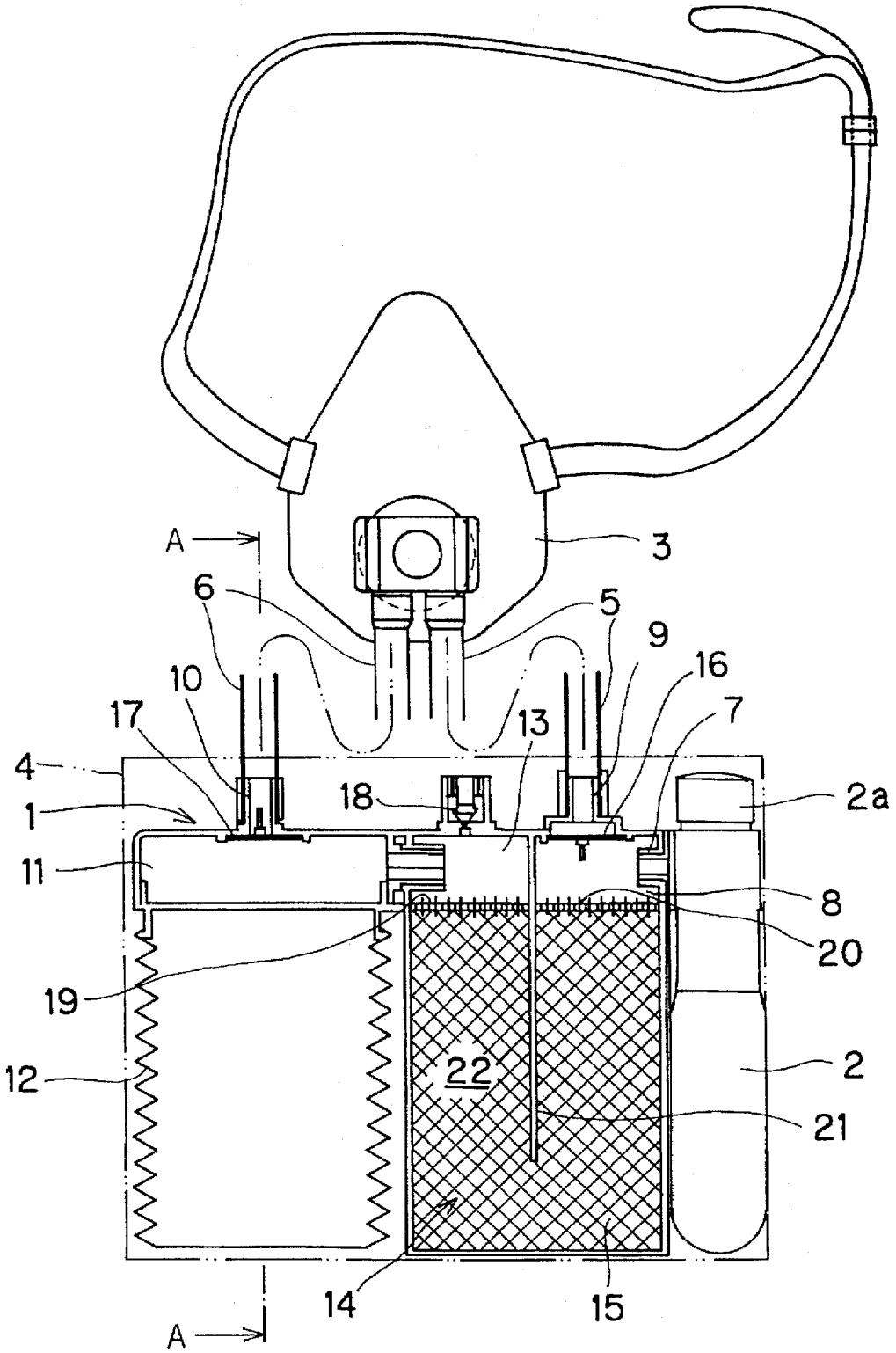
FIG. 2 is a front cross-sectional view depicting the schematic composition of a cylinder-type oxygen respirator of a first embodiment of the present invention.

Explanation will now be made in respect to examples of the oxygen respirator of the present invention. FIG. 2 is the front cross-sectional view depicting the schematic composition of a cylinder-type oxygen respirator of a first embodiment of the present invention and FIG. 3 is the cross-sectional view taken along the line A—A in FIG. 2, depicting the side view of the oxygen respirator of the first embodiment. In FIG. 2, a numeral 1 represents the body as the core part of the oxygen respirator; 2 an oxygen cylinder mounted in a removable manner onto the body 1; 3 a mask connected to the body; 4 a box containing the body 1 and the oxygen cylinder 2; 5 a first hose transferring oxygen from the body 1 to the mask 3; and 6 a second hose transferring exhalation from the mask to the body. A stopper member **2*a* is mounted on the head of the oxygen cylinder 2, and by turning the stopper member 2*a*, oxygen is released from the oxygen outlet 2*b*. The dimension of the body 1 of the oxygen respirator of FIGS. 1 and 2 is about 20 cm (length) ×about 25 cm (width) ×about 6 cm (depth), and the body has a structure of about the size of a lady's handbag with a slightly less depth. The oxygen cylinder 2 has a weight of about 500 grams, far lighter (by 1/20 to 1/40 fold) than conventional cylinders of about 10 kg to 20 kg. Therefore, the oxygen content is less approximately at this ratio. The total weight of the oxygen respirator of the Example is less of about 1 to 2 kg. Further, the oxygen cylinder 2** contains compressed oxygen of 95 to 100%.

On the body 1 are mounted a cylinder mounting part 7 for mounting the oxygen cylinder 2, an oxygen reservoir 8 formed inside the cylinder mounting part 7, and a hose connection part 9 connecting the first hose 5 to the body 1, and these individual members compose an oxygen supply part. The body 1 is also equipped with a hose connection part 10 connecting a second hose 6 to the body 1, an exhalation influx chamber 11 formed inside the hose connection part 10, a surge tank 12 being connected to the exhalation influx chamber 11 as a tank member for adjusting the flow of exhalation sent back from the mask 3 to the body 1 (specifically enabling a user to breath easily by absorbing and adjusting the change in the air pressure of exhalation), an exhalation reservoir 13 being connected to the exhalation influx chamber 11 separately from the surge tank 12 for temporarily reserving exhalation, and an air cleaning part 14 incorporating exhalation from the exhalation reservoir 13 and transferring it to the oxygen reservoir 8 while removing carbon dioxide in the exhalation. An air recycling part is composed of these individual members. The surge tank 12 can contain air of 2 to 3 liters.

On the body 1, the hose connection part 9 is also equipped with a one-way valve 16 controlling the oxygen flow from the body 1 to the mask 3, and the hose connection part 10 is equipped with a one-way valve 17 controlling the flow of exhalation from the mask 3 to the body 1. By these valves, the flows of oxygen and exhalation via the motion of respiration can be adjusted smoothly. Pressure adjusting valve 18 serving as a check valve is mounted on the exhalation reservoir 13 of the body 1, so as to prevent occurrence of abnormally high air pressure inside the exhalation reservoir 13. The air cleaning part 14 is composed of an exhalation inlet 19, an exhalation outlet 20, air circulation chamber 22 having a partition wall 21 being disposed between the exhalation inlet 19 and the exhalation outlet 20 and working as a containing area formed inside the body 1, and carbon dioxide absorbing material 15 charged inside the air circulation chamber 22. The partition wall 21 spaces the exhalation inlet 19 and exhalation outlet 20 at a long interval along the direction of air, whereby exhalation transferred inside the air cleaning part 14 reaches the exhalation outlet 20 via the maximum pathway. The exhalation outlet 20 of the air cleaning part 14 communicates with the oxygen reservoir 8, in which oxygen is mixed with air from that carbon dioxide is removed.

The operation of the oxygen respirator having such a structure will now be explained. For using the oxygen respirator, turning the stopper member **2*a* mounted on the head of the oxygen cylinder 2, oxygen can be fed from the oxygen outlet 2*b* into the oxygen reservoir 8. Oxygen fed from the oxygen cylinder 2 is mixed with air inside the oxygen reservoir 8, so that oxygen is put in the state of a decreased oxygen concentration. Following the respiration of a user, the oxygen is transferred through the first hose 5 from the body 1 to the mask 3. When a user breathes then, the oxygen is incorporated into the body of the user to expire exhalation containing carbon dioxide. The exhalation is transferred through the second hose 6 from the mask 3 to the body 1 to pass through the exhalation influx chamber 11 into the surge tank 12. The oxygen transferring from the body 1 to the mask 3 and the return of exhalation from the mask 3 to the body 1 are realized by the alternate opening motion of one-way valves 16 and 17. By receiving the influx of exhalation in the surge tank 12, buffer action is carried out. Alternatively, exhalation flows from the exhalation influx chamber 11 to the exhalation reservoir 13, separately from the surge tank 12, and is then temporarily reserved in the exhalation reservoir 13**.

When exhalation is transferred into the body 1 by the repetition of respiration, the exhalation flows from the exhalation reservoir 13 into the air circulation chamber 22. In the air circulation chamber 22 is charged carbon dioxide absorbing material 15 and the air circulation chamber 22 has a structure wherein the exhalation inlet 19 and the exhalation outlet 20 are spaced by the partition wall 21 at a distance as long as possible toward the air flow. Thus, the exhalation transferred into the air cleaning part 14 reaches the exhalation outlet 20 via the maximum pathway, while passing through the carbon dioxide absorbing material 15.

While exhalation passes through the carbon dioxide absorbing material 15 inside the air cleaning part 14, the carbon dioxide absorbing material removes carbon dioxide from the exhalation to increase the oxygen concentration, whereby the carbon dioxide content decreases in the exhalation so that the user can prevent the intoxication of carbon dioxide, indicating that exhalation can be used again. When persons breathe, generally, the oxygen in inhaled air is consumed at about several percentages (4 to 6%), while the remaining is contained in the exhalation for expiration. Since carbon dioxide is contained in exhalation, and however, persons continuously inhaling the exhalation which may cause the intoxication of carbon dioxide. This is because the bonding strength of carbon dioxide with blood (hemoglobin, in particular) is stronger than the strength of oxygen.

As has been described above in accordance with the present invention, carbon dioxide is removed from exhalation, so that air discharged from the air cleaning part 14 is one having a low carbon dioxide content and principally comprising nitrogen and oxygen, indicating possible reuse of exhalation. Sending back the air into the air reservoir 8 which is then mixed with oxygen at a high purity from the oxygen cylinder 2 to be transferred again into the mask 3, the oxygen charged in the oxygen cylinder 2 is circulated and reused for gradual consumption for a long duration. Thus, although the oxygen cylinder 2 of the Example is of the small size as has been described above and so with an extremely small volume, the oxygen respirator can be used safely for a long continuous life time of 20 to 30 minutes. Because the oxygen cylinder 2 is of a small scale with a less oxygen content, the respirator is not contradictory to the statutory regulations in terms of oxygen handling. Thus, the oxygen respirator of the present Example can be placed at almost any place from hotels, theaters, schools, various construction sites and the like to general houses.

In the oxygen respirator, furthermore, oxygen cylinder 2 should be used only once, so it is not intended that the cylinder 2 may be used in a dividend manner for several times. Possibly, the reason is that the extent of the remaining oxygen in an oxygen cylinder can be examined with difficulty, involving laborious control works, and that the amount of oxygen may get insufficient eventually to cause an accident due to inadequate control. So as to inform of the users that the use of the cylinder should be limited to only once, a sealing member should be mounted over the stopper member **2*a* of the oxygen cylinder 2** and the cylinder body, preferably. Furthermore, "the use of the cylinder limited to only once" herein referred to is not contradictory to "the reuse of oxygen" mentioned above. The "reuse of oxygen" herein refers to the reuse of oxygen through circulation and recycling in the "use of the cylinder limited to only once".

Figure 4:
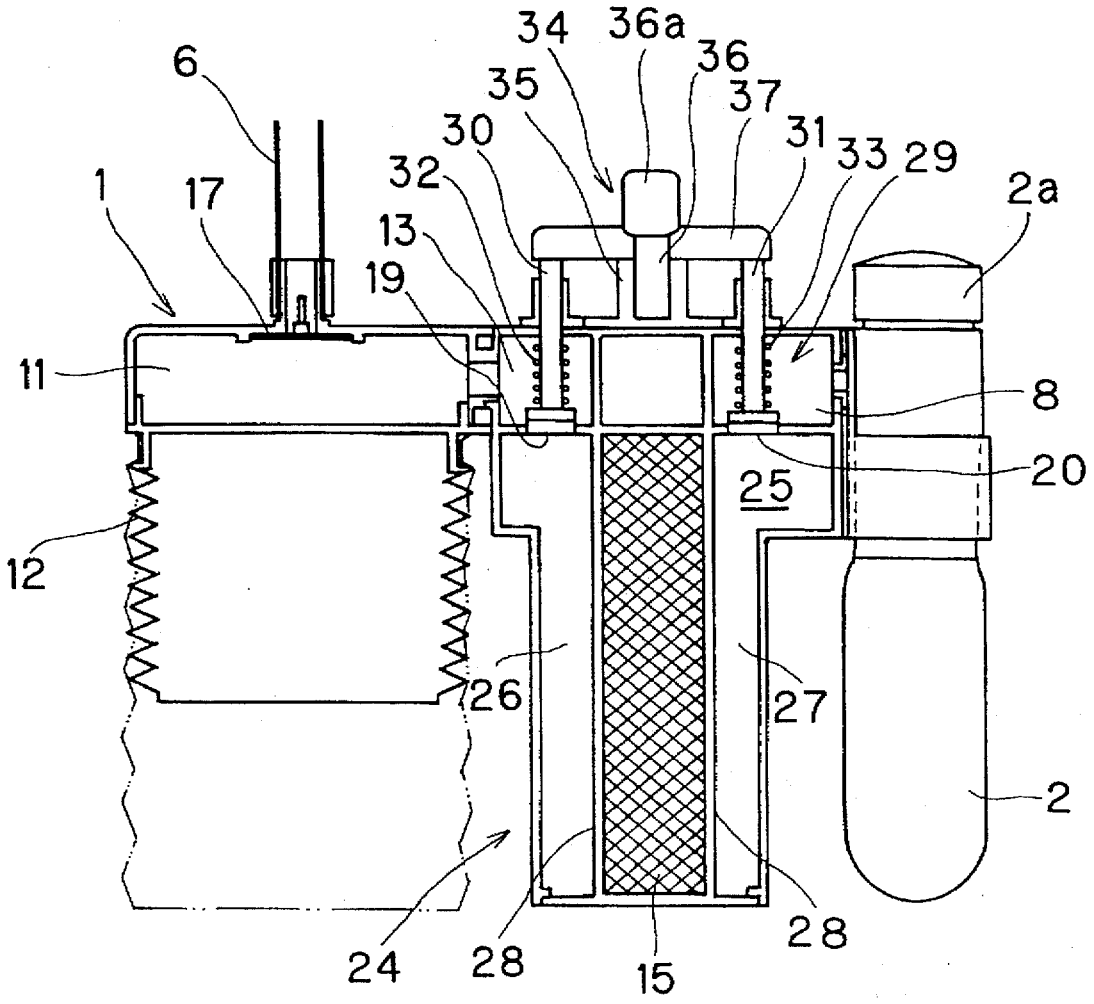
FIG. 4 is a front cross-sectional view depicting the schematic composition of the cylinder-type oxygen respirator of a second embodiment of the present invention.
Figure 5:
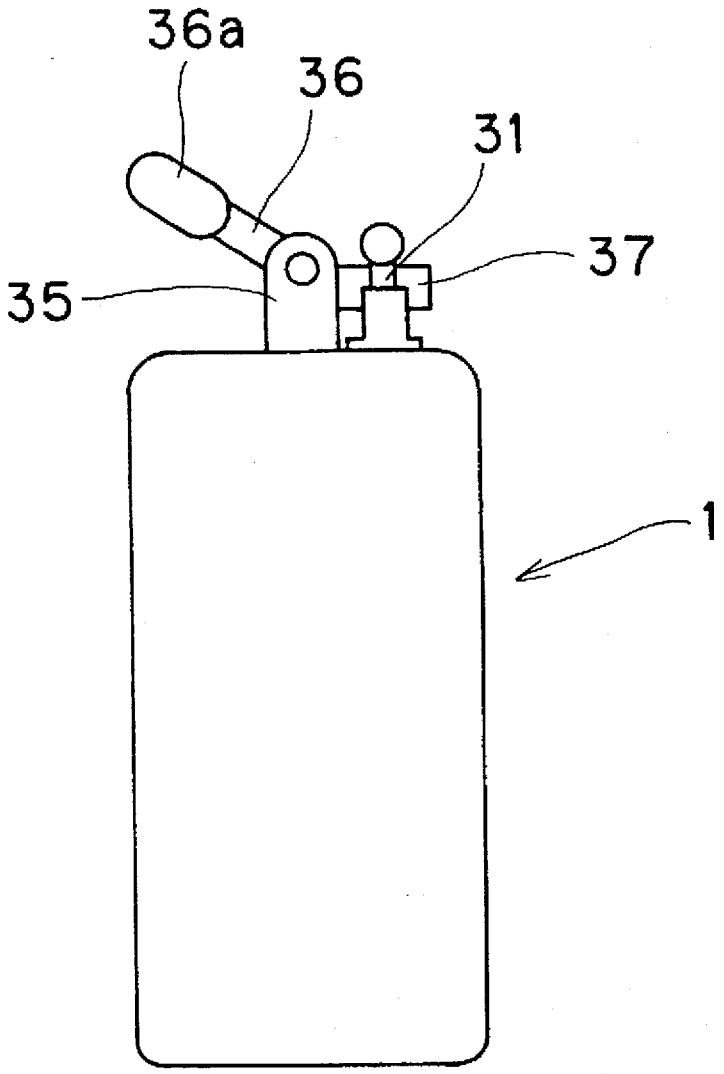
FIG. 5 is a side view of the oxygen respirator of the second embodiment.

A second embodiment of the present invention will now be explained. FIGS. 4 and 5 are figures depicting the second embodiment of the present invention. Among the figures, FIG. 4 is the front cross-sectional view depicting the schematic composition of the cylinder-type oxygen respirator of the second embodiment of the present invention; and FIG. 5 is the side view of the oxygen respirator of the second embodiment. The oxygen respirator herein is functionally the same as the oxygen respirator of the first embodiment, having a body 1, an oxygen cylinder 2 having a stopper member **2*a* and being mounted on the body 1, a mask 3, a box 4 (not shown in the figures), a first hose 5 and a second hose 6. Like the oxygen respirator of the Example 1, the oxygen respirator of the present embodiment has an oxygen supply part comprising a cylinder mounting part 7, an oxygen reservoir 8 and a hose connection part 9, and is equipped with a hose connection part 10, an exhalation influx chamber 11, a surge tank 12, an exhalation reservoir 13 and an air cleaning part 24, and all of these members compose an air recycling part. Also, the oxygen respirator has one-way valves 16 and 17**.

Unlike the first embodiment, inside the air circulation chamber 25 of the air cleaning part 24, are arranged an air introducing passage 26 communicating with the exhalation inlet 19, and an air exhausting passage 27 communicating with the exhalation outlet 20, wherein carbon dioxide absorbing material 15 is charged in a sandwich manner in a pair of air-permeating partition walls 28, 28 arranged between both the air passages 26 and 27. An exhalation inlet 19 and exhalation outlet 20 are opened in the form of openings on the ceiling parts of the air introducing passage 26 and the air exhausting passage 27, and the exhalation inlet 19 and the exhalation outlet 20 are closed by stopper member 29 comprising a valve mechanism.

The stopper member 29 is composed of valve body 30 of a bar-like structure, with the tip engaged with the exhalation inlet 19 and the base end elongating outwardly above the body 1, a valve body 31 having the same structure as that of the valve body 30 and being engaged with the exhalation outlet 20, and spring members 32, 33 intermediately disposed between the valve bodies 30, 31 and the upper plate of the body 1 for pressing individually the valve bodies 30, 31 toward the exhalation inlet 19 and the exhalation outlet 20, respectively. A stopper releasing member 34 being connected to the valve bodies 30, 31 in an operative manner for opening the stopper member 29 is mounted on the outer side of the upper face of the body 1. The stopper releasing member 34 is composed of a support 35 being mounted in a standing fashion on the upper face of the body, a lever 36 supported axially on the support 35 in a rotatable manner and having a gripping part 36*a* for handling, a connecting rod 37 elongating horizontally and being mounted on the tip part of the lever 36, both of the ends of the rod being connected to the base ends of the valve bodies 30, 31. Though not shown in the figures, by fixing the lever 36 and the like, the member 34 is connected to the lock mechanism to fix the stopper releasing member 34 at its releasing position when the stopper releasing member 34 is operated and released. Alternatively, the stopper member 29 keeps the exhalation inlet 19 and the exhalation outlet 20 at the closing state by the action of the spring members 32, 33 to seal the air circulation chamber 25 of the air cleaning part 24. When the stopper member 29 is operated and released by the stopper releasing member 34, the lever 36 pushes up the valve bodies 30, 31 against the action of the spring members 32, 33, whereby the procedure of oxygen respiration can be initiated for the first time.

The operation of the oxygen respirator having such a structure will be explained below. For the use of the oxygen respirator, turning the stopper member 2*a* mounted on the head of the oxygen cylinder 2, oxygen can be fed from the oxygen outlet 2*b* into the oxygen reservoir 8. When a user handles the lever 36 of the stopper releasing member 34 to release the stopper member 29, alternatively, the lever 36 pushes up the valve bodies 30, 31 against the action of spring members 32, 33 to open the exhalation inlet 19 and the exhalation outlet 20, and to break the air tightness of the air circulation chamber 25 of the air cleaning part 24. Either the stopper member 2*a* of the oxygen respirator or the stopper member 29 of the air cleaning part 24 may be released first. The operation thereafter may be the same as in the description of the first embodiment.

In the second embodiment as has been described above, the procedure of oxygen respiration can be established for the first time only after the stopper member 29 is released with the stopper releasing member 34, whereby the carbon dioxide absorption potency of the carbon dioxide absorbing material 15 never be deteriorated even when the material is brought into contact with air during the time with no use of the oxygen respirator, so that the respirator can keep the properties for a long time.

Figure 6:
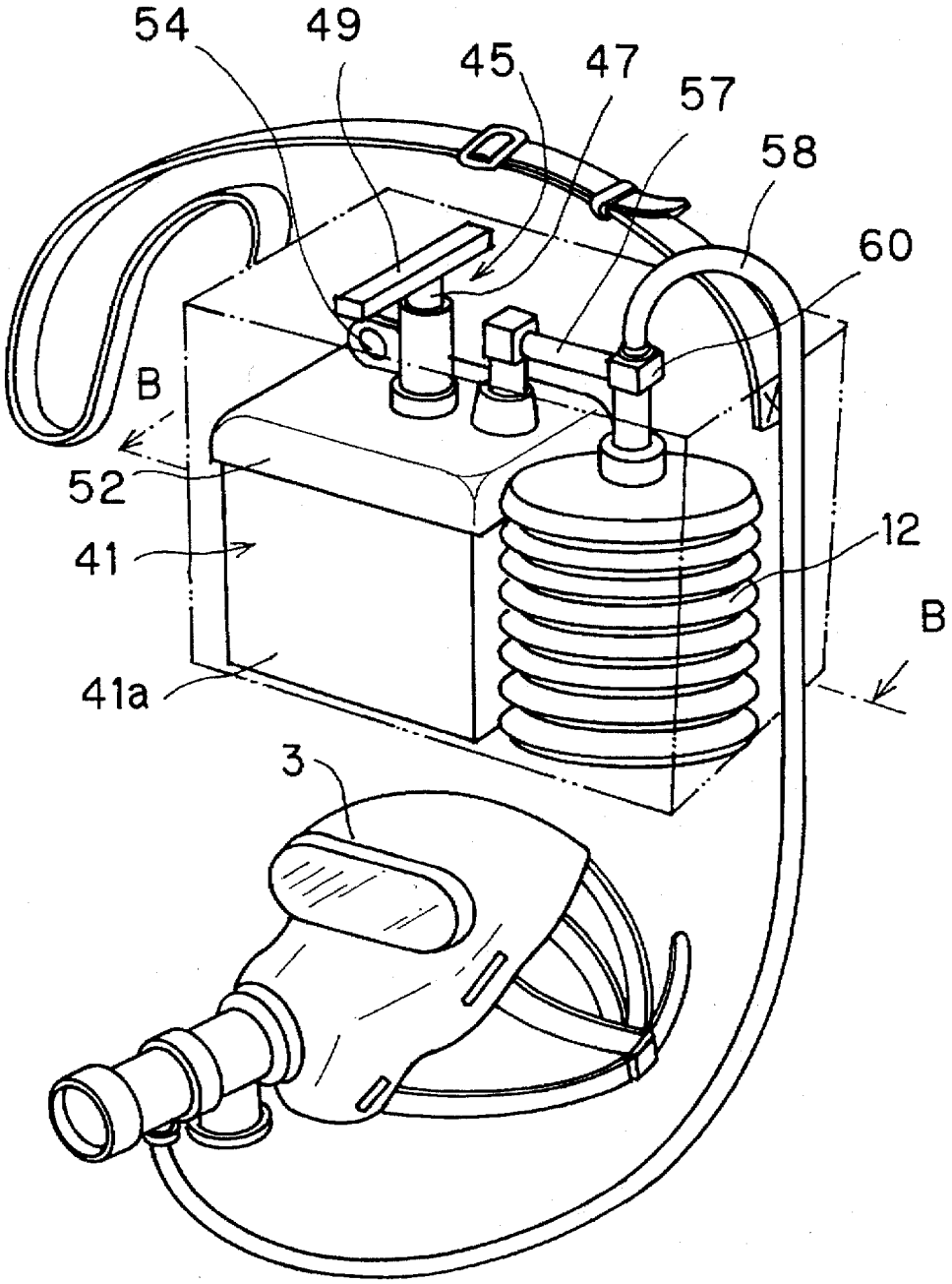
FIG. 6 is a perspective view depicting the schematic composition of the oxygen respirator equipped with an oxygen generator of a third embodiment of the present invention.
Figure 7:
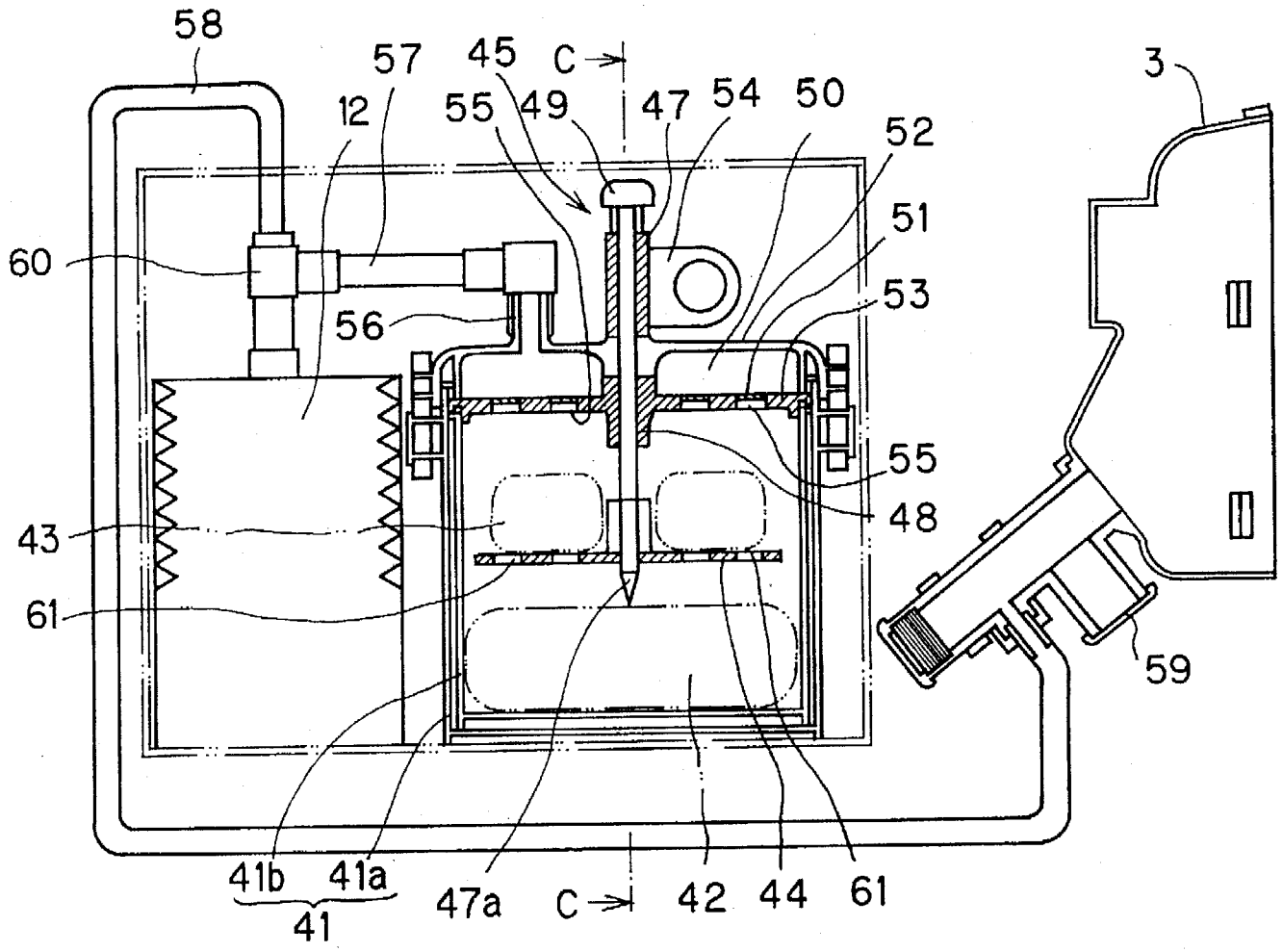
FIG. 7 is a front cross-sectional view taken along the line B—B in FIG. 6, depicting the inner structure of the oxygen respirator of the third embodiment.
Figure 8:
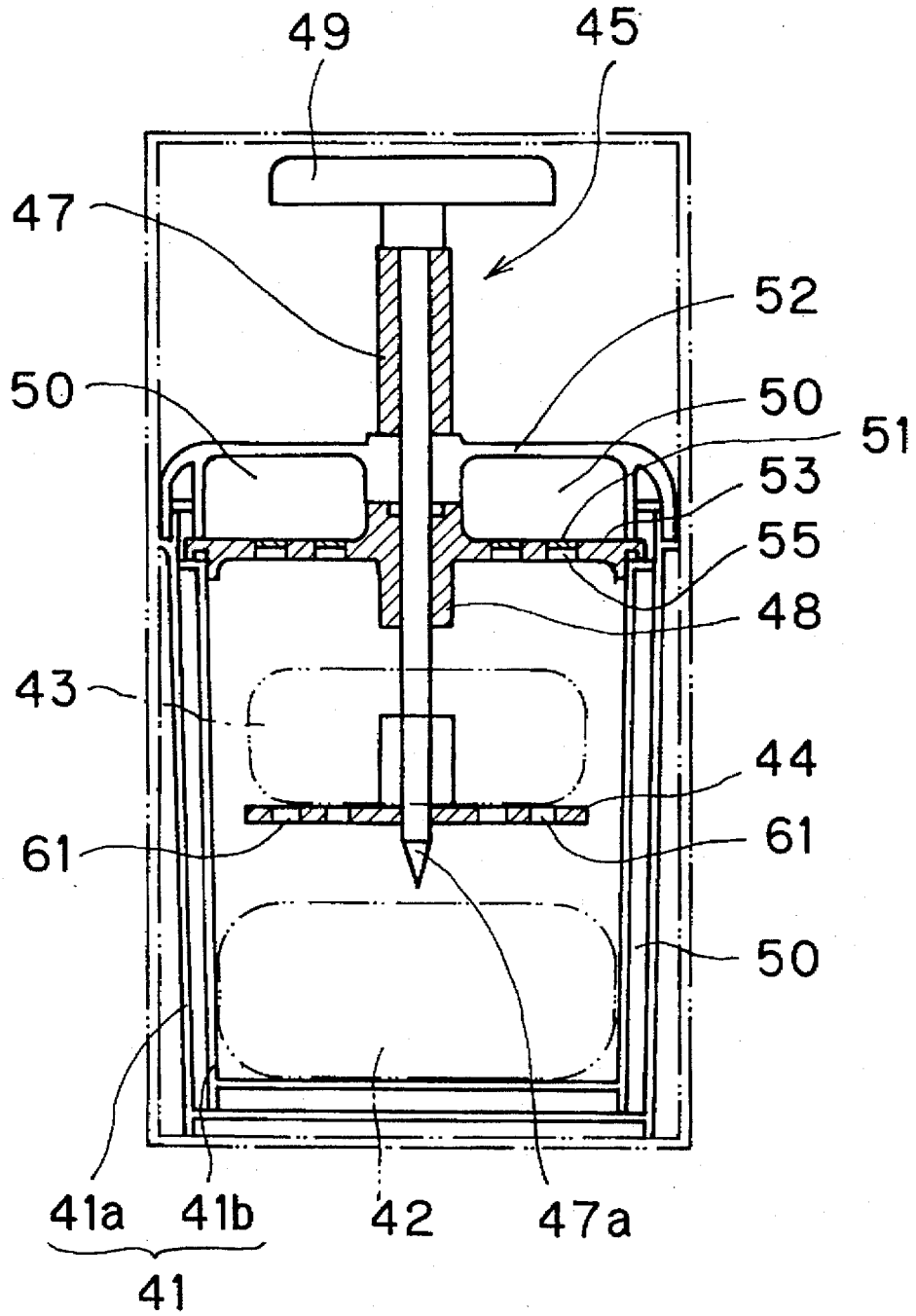
FIG. 8 is a front cross-sectional view taken along the line C—C in FIG. 7, depicting the inner structure of the oxygen respirator of the third embodiment.

Then, a third embodiment of the present invention will be explained. The oxygen respirator is of a type equipped with an oxygen generator, and FIGS. 6 to 8 are figures depicting the oxygen respirator of the third embodiment. FIG. 6 is the perspective view depicting the schematic composition of the oxygen respirator equipped with an oxygen generator, in accordance with the third embodiment of the present invention; FIG. 7 is the front cross sectional view taken along the line B—B in FIG. 6, depicting the inner structure of the oxygen respirator of the third embodiment; and FIG. 8 is the side cross sectional view taken along the line C—C in FIG. 7, depicting the inner structure of the oxygen respirator of the third embodiment.

The oxygen respirator of the Example is equipped with an oxygen generator 40. The oxygen generator 40 is composed of an outer case 41*a*, an inner case 41*b* contained in the outer case 41*a* for composing a container 41 together with the outer case 41*a* so as to generate oxygen therein, a tank 42 (referred to as a "liquid tank") placed at the bottom of the inner case 41*b* and containing therein one substance (generally liquid) required for oxygen generation, a tank 43 (referred to as a "chemical tank") containing therein the other substance (chemical substance; powdery solid in most cases) required for oxygen generation, a support 44 supporting one of the two tanks 42, 43 separately from the remaining tank, and a support handling member 45 transferring the support 44. As one example of substances required for oxygen generation, herein, a combination of hydrogen peroxide as liquid and manganese dioxide as chemical (powdery solid) should be charged in the liquid tank 42 and the chemical tank 43, separately. As a substance for oxygen generation, combination other than the that of hydrogen peroxide and manganese dioxide may be suggested; the liquid tank 42 may be a water bag containing water therein, while the chemical tank 43 may contain another chemical (solid) capable of generating oxygen through the reaction with water. In such a case, preferably, the liquid tank 42 may be placed on the bottom portion of the container 41, while the chemical tank 43 may be supported in the air above the liquid tank 42 by the support 44 so as to prevent the moistening of the inner powder.

A space 50 is formed between the outer case 41*a* and the inner case 41*b*, which space 50 communicates, through permeation membranes 41 placed in the inner case 41*b*, with the inner space of the inner case 41*b*. The permeation membranes 41 are placed at least on the upper and bottom portions of the inner case 41*b*. The liquid and chemical to be used for oxygen generation may be contained in the form of an exchangeable cartridge type for handling convenience. As such cartridge, the liquid tank 42 may be a bag made of vinyl chloride, and the chemical tank 43 for charging chemical may be of plastic-made mesh structure.

A support handling member 45 elongates through the central parts of the individual upper lids 52, 53 of the outer case 41a and the inner case 41*b*, respectively, toward the inside of the inner case 41*b*, and around the tip thereof is mounted a support 44, while the base portion elongates outwardly from the upper lid 52 of the outer case 41*a*. The support is composed of a needle or rod member 47 having a trigger 49 on the base end and a bearing member 48 being mounted on the upper lid 53 of the inner case 41*b* and supporting the needle 47 in the manner capable of vertical motion. The needle 47 connects the outer trigger 49 to the support 44 placing the chemical tank 43, and has a tip 47*a* facing downward. The trigger 49 is equipped with a safety device 54 for preventing motion error, so as to prevent the motion of the oxygen generator during the unnecessary time.

By removing the safety device 54 and pushing then the trigger 49, the tip 47*a* of the needle 47 can break the chemical tank 43, structurally. The support 44 is composed of a plane member, and structurally functions as a tank support to support the liquid tank 42 placed on the bottom of the inner case 41*b* and as a chemical shelf for placing chemical tank 3 and chemicals charged therein. Furthermore, a great number of liquid through holes 61 are formed on the plane member composing the support 44, to structurally enable the reaction of the chemical with the liquid from the liquid tank 42 broken by the needle 47.

All of the members, i.e. the outer case 41*a*, the inner case 41*b*, the support 44, the needle 47, and the trigger 49, are molded using plastic such as polypropylene and a vinyl chloride resin, and the outer case 41*a* and the inner case 41*b* are molded into a box having a thickness of about 2 mm by extrusion molding. The upper lid 52 of the outer case 41*a* is mounted on the outer case 41*a* with screws. The upper lid 53 of the inner case 41*b* is fixed on the inner case 41*b* with a fastener of one-touch type. The upper lid 53 and the bottom of the inner case 41*b* have through holes 55 for oxygen generation. The oxygen through holes 55 are closed by permeation membranes 51 welded onto the upper lid 53 and the bottom. The permeation membrane 51 has a characteristic property to permeate only gas without permeation of liquids such as water. The oxygen through holes 55 and the permeation membrane 51 may be placed on the side wall of the inner case 41*b*, not necessarily on the upper lid 53 and the bottom of the inner case 41*b*. As has been described above, when the oxygen through holes 55 are made on the side wall of the inner case 41*b* and the permeation membranes 51 are mounted thereon, the space 50 should also be formed on the outer side of the inner case 41*b* along the crosswise direction.

An oxygen transferring part 56 is made on the upper lid 52 of the outer case 41*a*, and one end of a pipe member 57 is connected to the oxygen transferring part 56. A surge tank 12 and a hose 58 are separately connected to the other end of the pipe member 57, while mask 3 is connected to the top of the hose 58. Inside the hose 58 are placed a gas feed hose (corresponding to the first hose 5 of the first embodiment) transferring generated oxygen to the mask 3, and a gas exhaust hose (corresponding to the second hose 6 of the first embodiment) transferring exhalation to the surge tank 12. A switch valve 60 is mounted on the multipoint connection of the pipe member 57 with the surge tank 12 and the hose 58, and when the motion of inhalation is carried out on the side of the mask 3, a continuity path transferring oxygen through the gas feed hose of the hose 58 from the oxygen generator to the mask 3 is opened. When the motion of inhalation is carried out on the side of the mask 3, a continuity path transferring exhalation through the gas exhaust hose of the hose 58 from the mask 3 to the surge tank 12 is opened. Furthermore, a valve member 59 is arranged around the connection of the mask 3 with the hose 58, to discharge a part of exhalation into air following the motion of exhalation on the side of the mask 3.

The motion of the oxygen respirator having such a structure will now be explained. When emergency disaster occurs such as fire, the oxygen respirator of the present invention should be worn. Then, removing the safety device 54 for releasing the lock and pushing the trigger, the needle 47 is pushed down so that the tip thereof 47*a* breaks the liquid tank 42. Then, the support 44 and the chemical placed thereon are thereby pushed down toward the bottom of the inner case 41*b* following the flow of the liquid inside the liquid tank 42, for the reaction of the liquid with the chemical to generate oxygen. The generated oxygen passes through the permeation membranes 51 and infiltrates into the space 50 between the outer case 41*a* and the inner case 41*b*, then passing through the hose 58 to enter into the mask 3.

In the third embodiment as has been described above, oxygen is generated through the motion of the oxygen generator as needed, so oxygen is not present normally. Therefore, the generator is far more convenient than those of the first and second embodiments in view of limitation to the place for placing the generator. Specifically, extremely strict preventive measures are enforced in airplanes against fire and explosive accidents, so oxygen cylinders and the like cannot be brought therein. Since the oxygen respirator of Example 3 does not have any oxygen cylinder, however, the respirator can be brought into airplanes. When emergency occurs, the respirator can exert its remarkable functions as an emergency oxygen respirator. The procedure of oxygen respiration can be established only after releasing the safety device, whereby motion error such as oxygen generation during the time with no use of the oxygen respirator, can be prevented.

Figure 9:
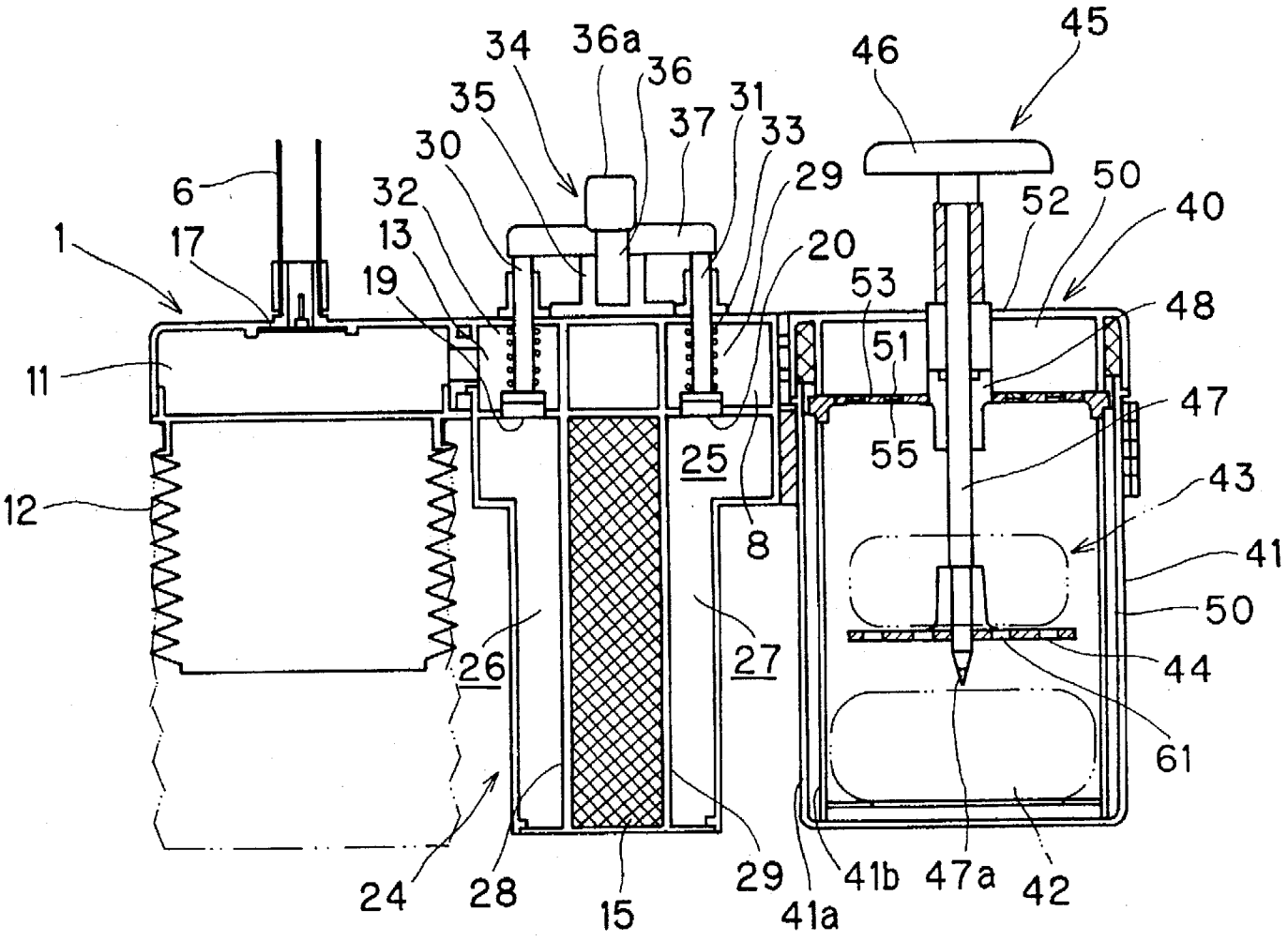
FIG. 9 is a front cross-sectional view depicting the schematic composition of the oxygen respirator equipped with an oxygen generator of a fourth embodiment of the present invention.

The fourth embodiment of the present invention will now be explained. FIG. 9 is the front cross sectional view depicting the schematic composition of the oxygen respirator of a type equipped with an oxygen generator, in accordance with Example 4 of the present invention. Structurally and functionally, the oxygen respirator of the present embodiment is almost the same as the oxygen respirator of the third embodiment, and some parts of the oxygen generator are fundamentally the same as that of the third embodiment. In this type of the oxygen respirator, inside air circulation chamber 25 of the air cleaning part 24 are placed the air introducing passage 26 communicating with the exhalation inlet 19, and air exhausting passage 27 communicating with the exhalation outlet 20, while the carbon dioxide absorbing material 15 is charged in a sandwich manner between a pair of air permeable partition walls 28 placed between both of the air passages 26 and 27. Alternatively, the exhalation inlet 19 and exhalation outlet 20 are opened on the ceiling parts of the air introducing passage 26 and the air exhausting passage 27, and the exhalation inlet 19 and the exhalation outlet 20 are closed by stopper member 29 comprising a valve mechanism. The stopper releasing member 34 being connected to the valve bodies 30, 31 in an operative manner for opening the stopper member 29 is mounted on the outer side of the upper face of the body 1. Furthermore, the stopper member 29 keeps the exhalation inlet 19 and the exhalation outlet 20 in the closing state by the action of the spring members 32, 33, when the oxygen respirator is not used, thereby sealing the air circulation chamber 25 of the air cleaning part 24. When the stopper member 29 is operated and released by the stopper releasing member 34, the lever 36 pushes up the valve bodies 30, 31 against the action of the spring members 32, 33, whereby the procedure of oxygen respiration can be initiated for the first time.

In the fourth embodiment, the oxygen generator 40 is mounted on the body 1 instead of an oxygen cylinder. The oxygen generator 40 has the same fundamental structure as that of the oxygen generator of the third embodiment, and the generator is composed of the container 41 for oxygen generation therein and being composed of the outer case 41*a* and the inner case 41*b*, the tank 42 placed at the bottom of the inner case 41*b* and containing therein one substance required for oxygen generation, the tank 43 containing therein the other substance required for oxygen generation, the support 44 supporting one of the two tanks 42, 43 separately from the remaining tank, and support handling member 45 transferring the support 44. As in Example 3, one example of substances required for oxygen generation in the present embodiment includes a combination of hydrogen peroxide as liquid and manganese dioxide as chemical (powdery solid) in the liquid tank 42 and the chemical tank 43, separately. The liquid tank 42 may be placed on the bottom portion of the container 41, while the chemical tank 43 may be supported in the air above the liquid tank 42 by the support 44 so as to prevent the moistening of the inner powder.

The support handling member 45 elongates through the upper wall of the container 41, and around the tip thereof is mounted the support 44, while the base portion elongates outwardly from the upper wall of the container 41. The support is composed of the needle or rod member 47 having the handle 46 on the base end, and the bearing member 48 being mounted on the upper wall of the container 41 and the supporting the needle 47 in the manner capable of vertical motion. As to the connection of the needle 47 with the bearing member 48, in the present embodiment unlike the third embodiment, male screws are formed on the outer circumference of the needle 47 while female screws are formed in the through holes of the bearing member 48 to connect via the screws the needle 47 with the bearing member 48. The tip 47*a* of the needle is sharpened in a conical form.

The motion of the oxygen respirator having such a structure will now be explained. Prior to using the oxygen respirator, turning the handle 45 made on the head of oxygen generator 40 in the clockwise direction, the needle 47 is pushed down by the action of pushing screws, so that the tip 47*a* thereof touches the tank 42. Then, pushing further downward the needle 47, the tip breaks the tank 42 so that a first substance, namely aqueous hydrogen peroxide, flows out from the inside. When tank 43 is dropped down onto the aqueous hydrogen peroxide, the tank is broken to release manganese dioxide to promote the decomposition of the aqueous hydrogen peroxide to generate oxygen. Oxygen is generated by such a manner, whereby oxygen can be fed into the inside of oxygen reservoir 8 of the body 1. Alternatively as has been described above, when a user operates the lever 36 of the stopper releasing member 34 to release the stopper member 29, the lever 36 pushes up the valve bodies 30, 31 against the action of the spring members 32, 33, to open the exhalation inlet 19 and exhalation outlet 20, and to break the air tightness in the air circulation chamber 25 of the air cleaning part 24. Either the stopper member 2*a* of the oxygen respirator or the stopper member 29 of the air cleaning part 24 may be released first. The operation thereafter is the same as explained in the first embodiment.

In the fourth embodiment as is described in the third embodiment, oxygen is generated through the motion of the oxygen generator only if necessary, so oxygen is not present normally. Therefore, the generator is far more convenient than those of the first and second embodiments in view of limitation to the place for placing the generator. Specifically, extremely strict preventive measures are enforced inside airplanes against fire and explosive accidents, so oxygen cylinders and the like cannot be brought in. Since the oxygen respirator of the fourth embodiment does not have any oxygen cylinder, however, the respirator can be brought into airplanes. When emergency occurs, the respirator can exert its remarkable functions as an emergency oxygen respirator. Furthermore, the procedure of oxygen respiration can be established for the first time only after the stopper member 29 is released by the stopper releasing member 34, whereby the carbon dioxide absorption potency of the carbon dioxide absorbing material 15 never be deteriorated even when the material has the contact with air during the time with no use of the oxygen respirator, so that the respirator can maintain the properties for a long time.

The Example 4 is equipped with the air cleaning part 24, whereby exhalation can be recycled effectively, and the present respirator can be used proportionally for a longer period than the oxygen respirator of the third embodiment.

In the second and fourth embodiment, though not shown in FIGS. 4 and 9, the first hose 5 transferring oxygen from the body 1 to the mask 3 is mounted on the ceiling part of the oxygen reservoir 8.

The present invention has been explained in the preferred embodiments, and various modifications and improvements will be apparent based on the explanation.

What is claimed is:

1. An oxygen respirator comprising:

a body having an oxygen reservoir;

oxygen means for supplying oxygen;

connection means for connecting the oxygen means for supplying oxygen to the body;

a mask to which oxygen incorporated from the oxygen means is transferred;

a first hose transferring oxygen from the body to the mask;

a tank member mounted on the body for receiving exhalation sent back from the mask to the body;

a second hose transferring exhalation from the mask to the body; and carbon dioxide absorbing material charged in the body for removing carbon dioxide from the exhalation transferred back from the mask to the body;

wherein the oxygen reservoir is formed on an inner side of a connection means portion of the body, a side of an air outlet of the carbon dioxide absorbing material communicates with the oxygen reservoir in which oxygen is mixed with the exhalation from which carbon dioxide is removed, the carbon dioxide absorbing material is contained in a containment area having an exhalation inlet and an exhalation outlet, and an air circulation chamber having a partition wall is disposed between the exhalation inlet and the exhalation outlet, the air circulation chamber comprising a containing area formed inside the body, whereby the partition wall spaces the exhalation inlet and exhalation outlet at a long interval along the direction of air so that exhalation transferred inside the containment reaches the exhalation outlet via the maximum pathway.

2. The oxygen respirator according to claim 1, wherein the oxygen means for supplying oxygen comprises an oxygen cylinder and the connection means comprises a cylinder mounting part for mounting the oxygen cylinder;

the oxygen cylinder being mounted on the cylinder mounting part to release oxygen into the body.

3. The oxygen respirator according to claim 2, wherein an exhalation reservoir is formed in front of the exhalation inlet of the containment area while a pressure adjusting valve for releasing exhalation when the pressure of. the exhalation reservoir reaches a predetermined value is mounted on the wall part of the exhalation reservoir.

4. The oxygen respirator according to claim 2, wherein stopper members are engaged with the exhalation inlet and the exhalation outlet in the containing area and by releasing the stopper members, the procedure of respiration can be established.

5. The oxygen respirator according to claim 4, wherein the stopper members engaged with the exhalation inlet and the exhalation outlet are connected in an operable manner to stopper releasing members for release from the outward of the body.

6. The oxygen respirator according to claim 5, wherein an exhalation reservoir is formed in front of the exhalation inlet of the containment area while a pressure adjusting valve for releasing exhalation when the pressure of the exhalation reservoir reaches a predetermined value is mounted on the wall part of the exhalation reservoir.

7. The oxygen respirator according to claim 1, wherein the oxygen means for supplying oxygen comprises an oxygen generating member for generating oxygen, and the connection means comprises a connection part with the oxygen generating member of the body.

8. The oxygen respirator according to claim 7, wherein an exhalation reservoir is formed in front of the exhalation inlet of the containment area while a pressure adjusting valve for releasing exhalation when the pressure of the exhalation reservoir reaches a predetermined value is mounted on the wall part of the exhalation reservoir.

9. The oxygen respirator according to claim 7, wherein stopper members are engaged with the exhalation inlet and the exhalation outlet in the containing area and by releasing the stopper members, the procedure of respiration can be established.

10. The oxygen respirator according to claim 9, wherein the stopper members engaged with the exhalation inlet and the exhalation outlet are connected in an operable manner to stopper releasing members for release from the outward of the body.

11. The oxygen respirator according to claim 10, wherein an exhalation reservoir is formed in front of the exhalation inlet of the containment area while a pressure adjusting valve for releasing exhalation when the pressure of the exhalation reservoir reaches a predetermined value is mounted on the wall part of the exhalation reservoir.

* * * * *